US007732707B2

(12) United States Patent
Kim

(10) Patent No.: US 7,732,707 B2
(45) Date of Patent: Jun. 8, 2010

(54) GROUND ROD AND CONNECTION SLEEVE FILLED WITH COMPOUND OF ELECTRIC CONDUCTION

(75) Inventor: Geun Hwan Kim, Seoul (KR)

(73) Assignee: Korea Electric Power Corporation, Seoul (KR)

( * ) Notice: Subject to any disclaimer, the term of this patent is extended or adjusted under 35 U.S.C. 154(b) by 146 days.

(21) Appl. No.: 12/083,854

(22) PCT Filed: Oct. 18, 2006

(86) PCT No.: PCT/KR2006/004244

§ 371 (c)(1),
(2), (4) Date: May 2, 2008

(87) PCT Pub. No.: WO2007/046635

PCT Pub. Date: Apr. 26, 2007

(65) Prior Publication Data

US 2009/0233470 A1 Sep. 17, 2009

(30) Foreign Application Priority Data

Oct. 18, 2005 (KR) ..... 10-2005-0098090

(51) Int. Cl.
*H01R 4/66* (2006.01)

(52) U.S. Cl. ..... 174/7; 174/6; 439/100

(58) Field of Classification Search ..... 439/100; 174/6, 7

See application file for complete search history.

(56) References Cited

U.S. PATENT DOCUMENTS 2,111,799 A * 3/1938 Newpher ..... 174/7
2,157,180 A * 5/1939 Little ..... 204/196.21
2,535,129 A * 12/1950 Gill ..... 361/118
3,582,531 A * 6/1971 Sheelor ..... 174/6
4,156,793 A * 5/1979 Carlson ..... 174/7
4,577,053 A * 3/1986 Kies ..... 174/7
7,282,637 B2 * 10/2007 Stockin et al. ..... 174/6

FOREIGN PATENT DOCUMENTS

| | | |
|---|---|---|
| JP | 01103173 | 7/1989 |
| JP | 06106274 | 4/1994 |
| JP | 9009454 | 1/1997 |
| KR | 1019820002571 | 6/1982 |
| KR | 8302415 | 10/1983 |
| KR | 0154406 | 11/1998 |
| KR | 200302408 | 1/2003 |
| KR | 20030030283 | 4/2003 |

* cited by examiner

*Primary Examiner*—Michael C Zarroli
(74) *Attorney, Agent, or Firm*—IpHorgan Ltd.

(57) ABSTRACT

An installation structure of a ground rod for driving the rod deep into the ground comprising an overhead earth wire installed to protect transformers, power-transmission lines, etc. from lightning; a ground wire that is extended from a lightning arrester to a ground; a multi-stage ground rod elongated by a thread type connection and connected with the end of the ground wire that it is buried into the ground; and a connecting sleeve for connecting the ground rod to the ground wire, the electric conductive compound preventing corrosion in the thread connection including a lead terminal side junction of the and a ground wire side junction of the connecting sleeve. Corrosion of the gap between junctions is inhibited by inserting electric conductive compound into the junctions of the lead terminal side and of the ground wire side of the ground wire connecting sleeve, increasing ground rod lifetimes and decreasing maintenance costs.

6 Claims, 5 Drawing Sheets

GROUND ROD AND CONNECTION SLEEVE FILLED WITH COMPOUND OF ELECTRIC CONDUCTION

BACKGROUND OF THE INVENTION

1. Technical Field

The present invention relates to the field of a ground rod for driving the rod deep into the ground, and more particularly to an installation structure of a ground rod for driving the rod deep into the ground that prevents a moisture from infiltrating into gaps of a connection of the ground rod, a junction of a lead terminal side of a ground wire connecting sleeve and a junction of a ground wire side of the ground wire connecting sleeve, and thus that prevents corrosion from occurring on the junction of a metal material.

2. Background Art

The grounding facility is a primary safety device in the electrical facility. The inadequateness of the grounding facility in the electrical facility may cause an electric shock to the body or a failure/malfunction of electronics. Therefore, the maintenance of the sufficient grounding facility for preventing the above-mentioned problems is very important.

According to the guidelines of the occupational safety agency, if an electric pole is installed in the area that may contact people, a ground electrode should be inserted into the ground more than 75 cm. Further, ground resistance of the electric pole having a transformer must be below 25Ω according to the electrical facility technical standard.

SUMMARY OF THE INVENTION

As a result of the many underground facilities, such as water pipes, gas pipelines, electrical pipelines, etc., in the big city, it is so much hardship to obtain ground resistance suitable to the electrical facility technical standard. Therefore, a structure of a hot-dip zinc coated ground rod was published.

Figure 1:
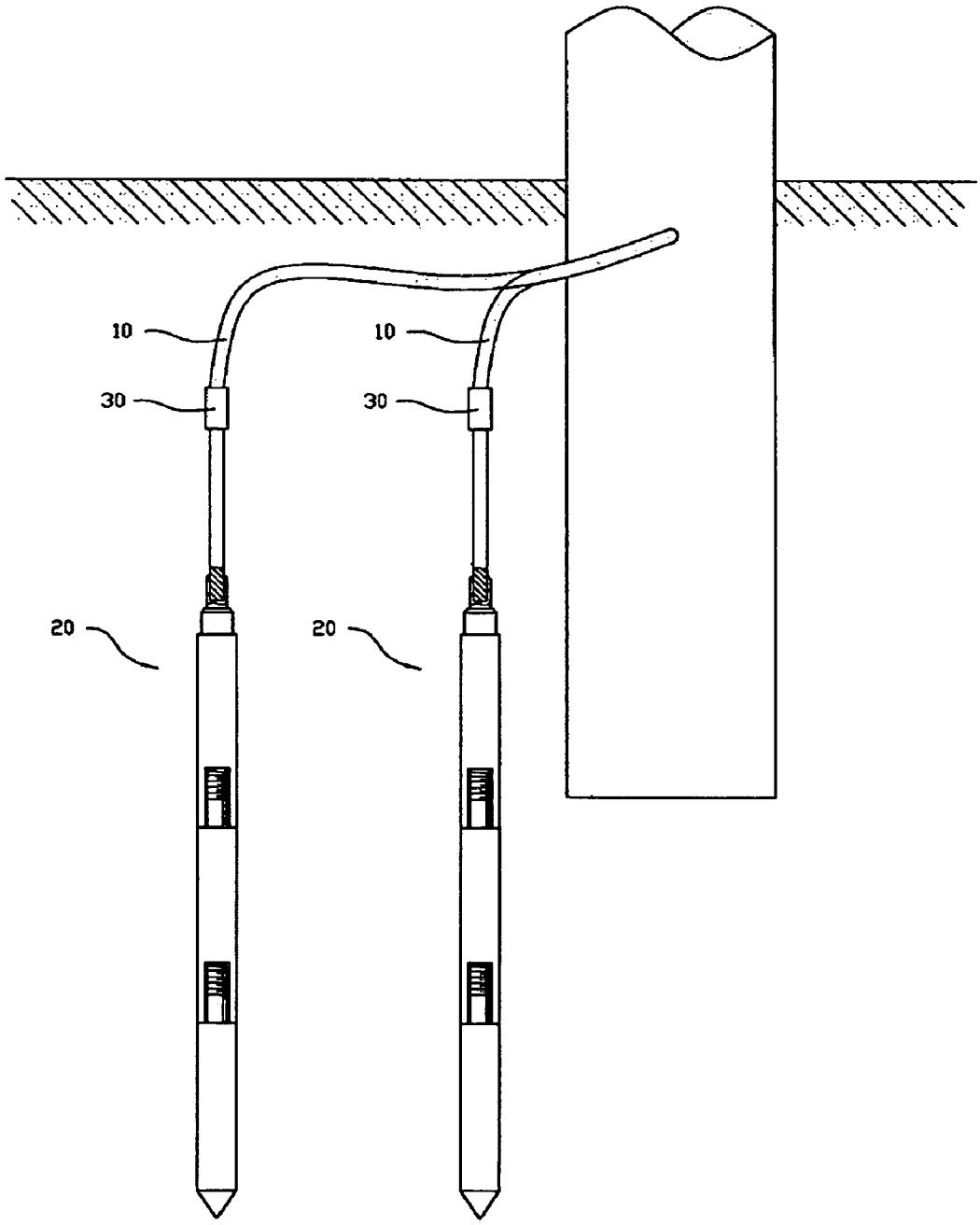

FIG. 1 is a schematic view illustrating an installation structure of the conventional ground rod. The conventional ground rod, as shown in FIG. 1, comprises a ground wire 10 extended from a lightning arrester for protecting the transformer and power-transmission lines to the ground, a multi-stage ground rod that is elongated by a thread type connection under the condition that it is connected with the end of the ground wire 10 and buried into the ground, and a connecting sleeve 30 for connecting the ground rod 20 to the ground wire 10.

However, the conventional installation structure of the ground rod has a problem that the respective connection part of the ground rod 20 and the gap between the connecting sleeve 30 and the ground wire 10 are corroded in the long run due to the moisture infiltrated therein. Therefore, the life time of the ground rod 20 and the connecting sleeve 30 is shortened, conductivity is reduced, and thus it cannot discharge the lightning properly.

Furthermore, the corrosion increases affairs due to maintenance and replacement, and produces unnecessary costs.

The present invention, as described in the above-description, prevents corrosion of the gap between the junctions by inserting the electric conductive compound into the junctions of the lead terminal side of the ground wire connecting sleeve and of the ground wire side of the ground wire connecting sleeve, and it increases the life time of the ground rod, and thus it decreases maintenance costs.

BRIEF DESCRIPTION OF DRAWING FIGURES

Figure 2:
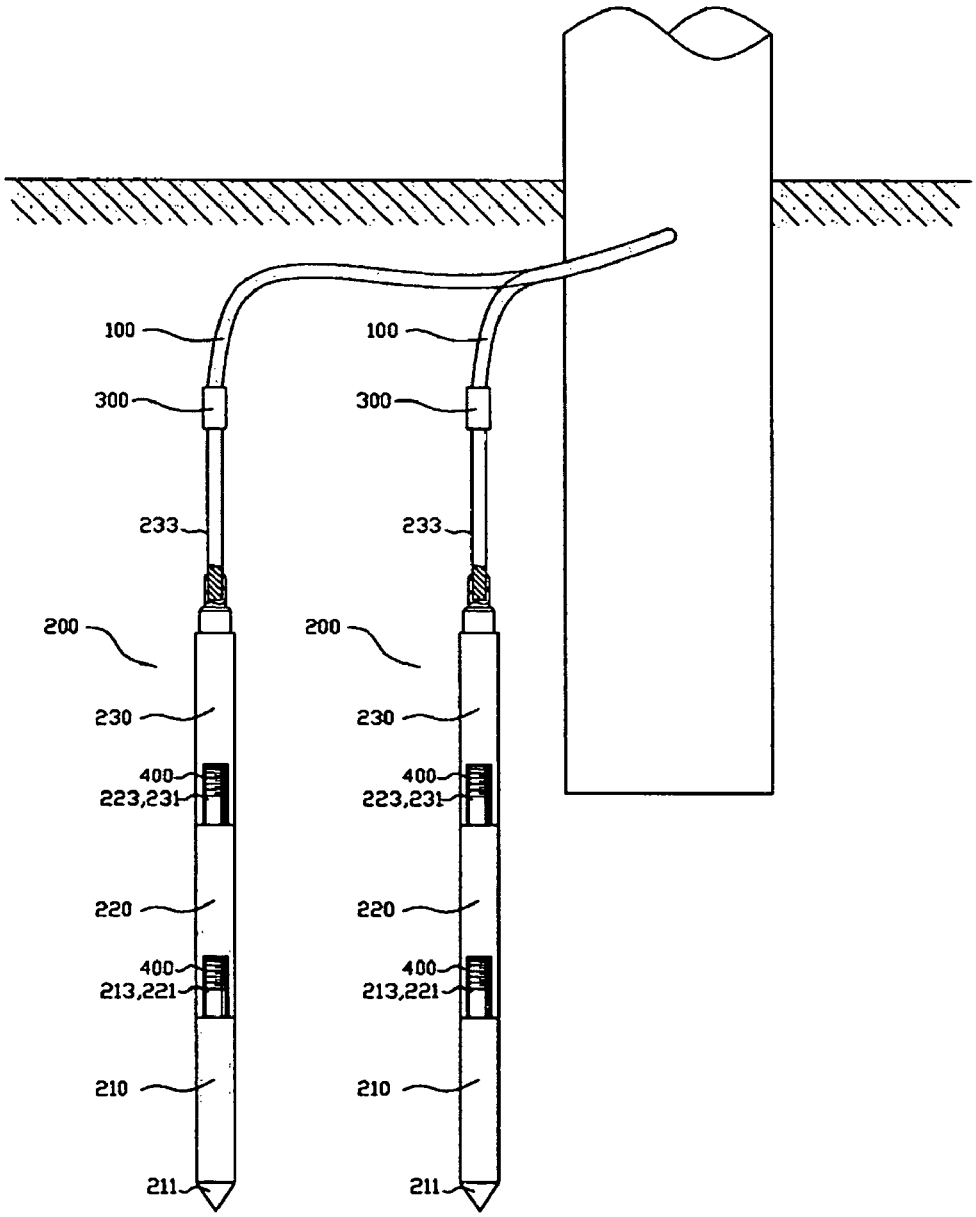
Figure 3:
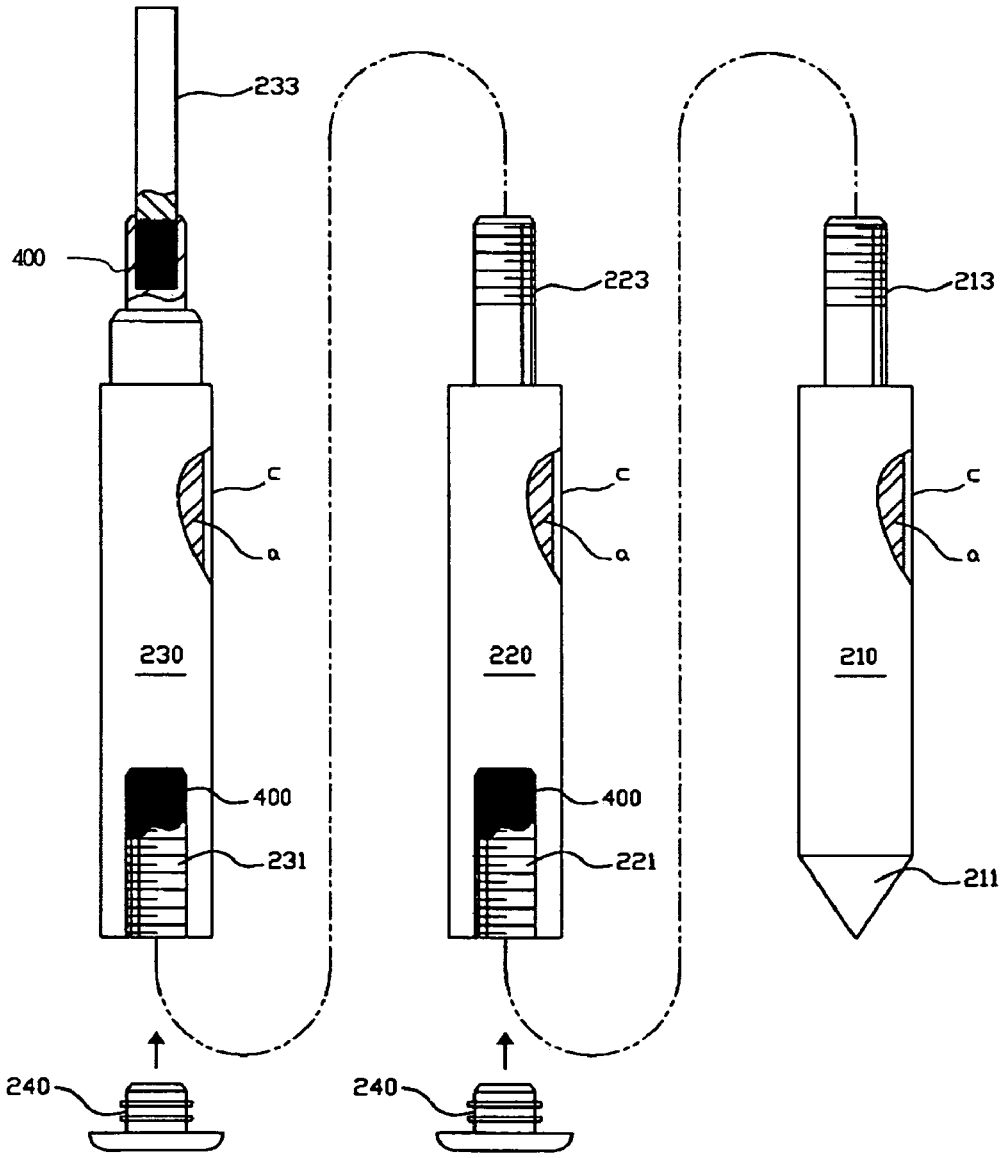
Figure 4:
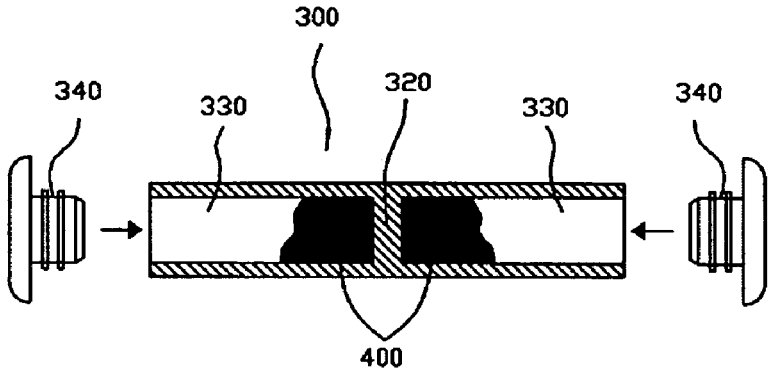
Figure 5:
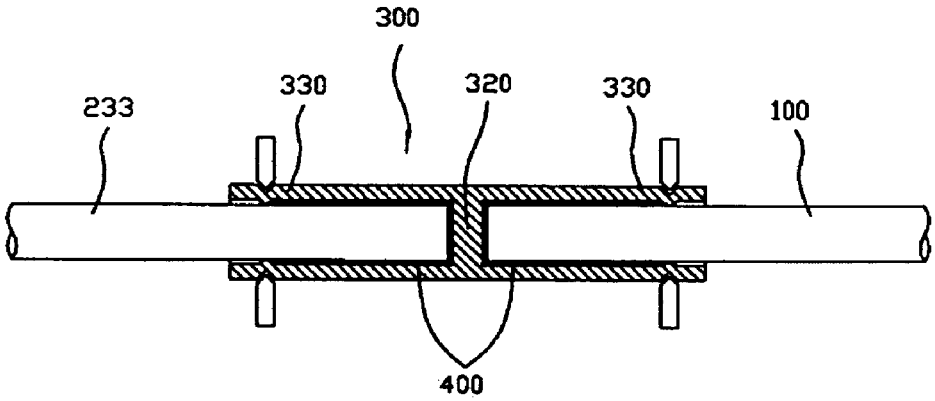
Figure 6:
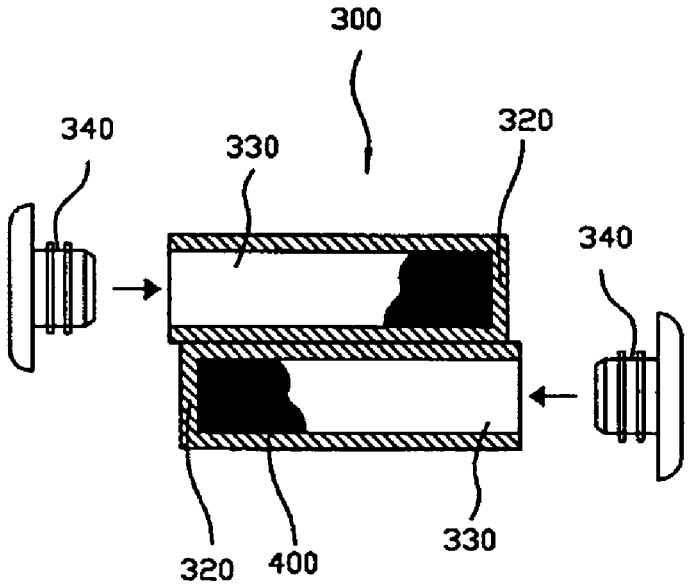
Figure 7:
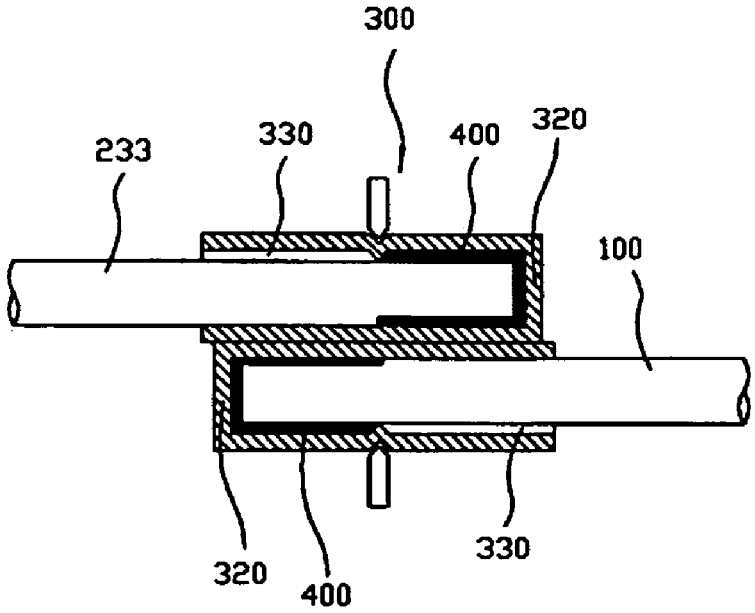

FIG. 1 is a schematic view of an installation structure of a ground rod according to the prior art, FIG. 2 is a schematic view of an installation structure of the ground rod according to an embodiment of the present invention, FIG. 3 is an exploded front view of the ground rod according to the embodiment of the present invention, FIG. 4 is a cross-sectional view which illustrates a structure of a connecting sleeve according to the embodiment of the present invention, FIG. 5 is a cross-sectional view which illustrates a state connecting a ground wire by use of the connecting sleeve of FIG. 4, FIG. 6 is a cross-sectional view which illustrates a structure of a connecting sleeve according to another embodiment of the present invention, and FIG. 7 is a cross-sectional view which illustrates a state connecting a ground wire by use of the connecting sleeve of FIG. 6.

DETAILED DESCRIPTION OF THE PREFERRED EMBODIMENTS

The objects, features and advantages of the present invention will be fully understood and appreciated from the following detailed description of the accompanying drawings.

While preferred embodiments have been shown and described, various modifications and substitutions may be made thereto without departing from the spirit and scope of the invention. Accordingly, it is to be understood that the present invention has been described by way of illustration and not limitation.

FIG. 2 is a schematic diagram of an installation structure of the ground rod according to an embodiment of the present invention. As shown in FIG. 2, the ground rod comprises an overhead earth wire that is installed to protect the transformer and the power-transmission lines from the lightning, and a ground wire 100 that is extended from the lightning arrester to the ground; a multi-stage ground rod 200 that is elongated by a thread type connection under the condition that it is connected with the end of the ground wire and buried into the ground; and a connecting sleeve 300 for connecting the ground rod 200 to the ground wire 100, wherein an electric conductive compound 400 is provided in a thread type connection, a junction 330 of a lead terminal 230 side of the connecting sleeve 300 and a junction 330 of a ground wire 100 side of the connecting sleeve 300.

FIG. 3 is an exploded front view of the ground rod according to the embodiment of the present invention. As shown in FIG. 3, the ground rod 200 comprises a basic part 210 forming a conical tip 211 for penetrating into the ground in one end of the rod shape made of a, and a thread rod 213 in the other end of the rod shape made of a; a multitude of connecting rods 220 forming a nut hole 221 corresponding to the thread rod 213 of the basic for being connected with the basic part in the one end of the rod shape made of a, a thread rod 223 which is of same size in the other end; and a lead terminal 230 forming a nut hole 231 in the one end of the rod shape made of a, and inserting a lead wire 233 in the other end, wherein the electric conductive compound 400 in a gel-state is provided in the nut holes 221 and 231, respectively.

The ground rod 200 is transferred and stored under the condition that it is divided into a basic part 210, a multitude of connecting rods 220 and a lead terminal 230, before it is driven into the ground.

Wherein, the respective nut hole 221 and 231 may be encapsulated by a sealing cap 240 to prevent the electric conductive compound 400 from leaking.

Of course, the sealing cap 240 should be removed so as to assemble the basic part 210, the connecting rod 220 and the lead terminal 240 together, and if the thread rod 213, 223 is inserted into the nut hole 221, 231 in which the electric conductive compound 400 is filled, then the electric conductive compound 400 fills the minute gaps up and prevents corrosion due to an infiltration of the moisture and air.

It is preferable that the electric conductive compound 400 is composed of a grease of 33 to 37% by weight, silicon carbide particles of 64 to 66% by weight, and a small amount of Na, Ca of 1% by weight, and that the following conditions should be met. The dropping point is the same or more than 120° C., it does not flow the same or less than 100° C., no crack occurs the same or less than −30° C., it is neutral, and an amount of evaporation is the same or less than 3%. Furthermore, it is preferable that the outer surfaces of the basic part 210, the connecting rod 220 and the lead terminal 240 are dealt with anti-corrosion process, that an outer diameter of the basic part 210, the connecting rod 220 and the lead terminal 240 is 25 mm, and that a material of the steel materials is a SM45C (carbon steel materials for machine).

Wherein, the connection of the lead wire 233 of the lead terminal 230 is made by driving the lead wire 233 into the recess after the recess is formed.

FIG. 4 is a cross-sectional view which illustrates a structure of a connecting sleeve according to the embodiment of the present invention. As shown in FIG. 4, the connecting sleeve 300 is configured that the diaphragm 310 is formed in the center of the tube, the respective junction 330 for inserting the ground wire 100 and the lead wire 233 into the left/right side of the diaphragm 310 is formed, and the electric conductive compound 400 is provided in the respective junction 330.

Wherein, it is preferable that the connecting sleeve 300 is encapsulated by the sealing cap 340 at the junction 330 and stored until it is connected to the ground wire 100.

FIG. 5 is a cross-sectional view which illustrates a state connecting a ground wire by use of the connecting sleeve of FIG. 4. As shown in FIG. 5, the ground wire 100 and the lead wire 231 are inserted into the junctions 330 under the condition that the sealing caps 340 are removed. Wherein, the gaps between the ground wire 100/the lead wire 231 and the junction 330 are filled up with the electric conductive compound 400 provided in the junction 330, and thus the infiltration of moisture is prevented.

In this state, if each end of the junction 330 of the connecting sleeve 300 is pressed by a presser, then the ground wire 100 and the connecting wire 231 is fixed therein and the leakage of the electric conductive compound 400 is prevented.

FIG. 6 is a cross-sectional view which illustrates a structure of a connecting sleeve according to another embodiment of the present invention. As shown in FIG. 6, the connecting sleeve 300 is configured that the tubes are connected in a row with a state that one end of the connecting sleeve 300 is closed by the diaphragm and the other end is open.

Wherein, the respective tube is arranged in the opposite direction to each other, and the electric conductive compound 400 is disposed in the junctions 330, respectively.

In the same way, it is preferable that the connecting sleeve 300 is encapsulated by the sealing cap 340 at the junction 330 and stored until it is connected to the ground wire 100.

FIG. 7 is a cross-sectional view which illustrates a state connecting a ground wire by use of the connecting sleeve of FIG. 6. As shown in FIG. 7, the ground wire 100 and the lead wire 231 are inserted into the junctions 330 under the condition that the sealing caps 340 are removed. Wherein the ground wire 100 and the lead wire 231 is overlapped within a specific territory. In this state, if the center of the junction 330 of the connecting sleeve 300 having a multitude of tubes fixed in a row is pressed by the presser, then the ground wire 100 and the connecting wire 231 is fixed therein and the leakage of the electric conductive compound 400 is prevented, and thus the infiltration of moisture is prevented.

What is claimed is:

1. A ground rod and connection sleeve filled with an electric conduction compound comprising:

an overhead earth wire that is installed to protect a transformer and power-transmission lines from lightning;

a lead terminal made of steel and having a nut hole in one end and having a member for receiving a lead wire at the opposite end;

a basic part made of steel and terminating at a conical tip for penetrating into the ground, and a thread rod at an end of the basic part opposite of the conical tip;

a connecting rod made of steel and having a nut hole at one end of the connecting rod and corresponding to the thread rod of the basic part for connecting the connecting rod and basic part and a thread rod at the opposite end for connecting the connecting rod and lead terminal;

a connecting sleeve for connecting the ground rod to the ground wire at the lead wire; and an electric conductive compound for preventing corrosion provided in the junctions of the nut holes and thread rods and in the connecting sleeve.

2. The ground rod and connection sleeve filled with an electric conduction compound according to claim 1, wherein the ground rod is stored in a disassembled condition wherein it is divided into the basic part, the connecting rod, and the lead terminal, and the electric conductive compound is encapsulated and stored by sealing the nut holes with sealing caps.

3. The ground rod and connection sleeve filled with an electric conduction compound according to claim 1, wherein a connection of the lead wire to the lead terminal is made by driving the lead wire into the member for receiving the lead wire.

4. The ground rod and connection sleeve filled with an electric conduction compound according to claim 1, wherein the connective sleeve comprises a diaphragm formed in the center of a tube and defining a left and right side in the tube with each side forming a junction for receiving the ground wire or lead wire and the electric conductive compound is provided in each junction.

5. The ground rod and connection sleeve filled with an electric conduction compound according to claim 1, wherein the connection sleeve comprises at least 2 tubes laid side-by-side with each tube being open ended on opposite sides of the sleeve and each forming a junction for receiving the ground wire or the lead wire with the electric conductive compound provided in each junction.

6. The ground rod and connection sleeve filled with an electric conduction compound according to claim 1, wherein the electric conductive compound is composed of a grease of 33 to 37% by weight, silicon carbide particles of 62 to 66% by weight, and Na and Ca of 1% by weight.

* * * * *